US010150284B2

(12) United States Patent
Simon

(10) Patent No.: US 10,150,284 B2
(45) Date of Patent: Dec. 11, 2018

(54) SHEET ASSEMBLY FOR THREE-DIMENSIONAL INFORMATIONAL CARD

(71) Applicant: Andrea Jill Simon, Coral Springs, FL (US)

(72) Inventor: Andrea Jill Simon, Coral Springs, FL (US)

( * ) Notice: Subject to any disclaimer, the term of this patent is extended or adjusted under 35 U.S.C. 154(b) by 451 days.

(21) Appl. No.: 15/000,672

(22) Filed: Jan. 19, 2016

(65) Prior Publication Data

US 2016/0129686 A1 May 12, 2016

Related U.S. Application Data

(62) Division of application No. 14/075,199, filed on Nov. 8, 2013.

(51) Int. Cl.
*B41F 17/00* (2006.01)
*B42D 15/04* (2006.01)
(Continued)

(52) U.S. Cl.
CPC ..... *B41F 17/00* (2013.01); *B42D 15/04* (2013.01); *B42D 15/042* (2013.01); *B65H 45/12* (2013.01); *G09F 1/06* (2013.01); *Y10T 428/15* (2015.01)

(58) Field of Classification Search
CPC ..... B41F 17/00; B42D 15/04; B42D 15/042; B42D 15/008; B42D 15/0086; B65H 45/12; G09F 1/06; G09F 1/04; G09F 3/10
(Continued)

(56) References Cited

U.S. PATENT DOCUMENTS 2,084,922 A * 6/1937 Sidebotham ..... B65D 5/04 229/90
4,704,317 A * 11/1987 Hickenbotham ..... B65H 3/46 428/156

(Continued)

FOREIGN PATENT DOCUMENTS

EP 1927478 B1 2/2011
FR 1524168 5/1968

(Continued)

OTHER PUBLICATIONS

Video advertisement of TAM Cargo Business Card, published by Eduardo Quadra on May 27, 2010, retrieved on Jun. 5, 2018 from URL https://www.youtube.com/watch?v=zMR_HCN21jk.*

(Continued)

*Primary Examiner* — Hemant M Desai
*Assistant Examiner* — Valentin Neacsu
(74) *Attorney, Agent, or Firm* — Lewis Brisbois Bisgaard & Smith LLP; Geoffrey Lottenberg, Esq.

(57) ABSTRACT

A three-dimensional informational or display card assembly manually moveable from a box-like configuration to a flat planar card configuration. The card assembly includes score lines for folding the card assembly. The ends of the card assembly are attached to each other by an adhesive or a mechanical means to form the box-like configuration. The sections of the card assembly are printable to receive printed indicia such that in the box-like configuration an onlooker can view the indicia both on the outside and on the inside of the card assembly. Also included is a sheet assembly that contains one or more of the card assemblies to allow a user to print indicia on the card assemblies and remove them from the sheet assembly for assembling into the final product. The card assembly may be dimensioned similar to a (Continued)

wallet-sized business card to provide a unique and interesting alternative to traditional business cards.

13 Claims, 4 Drawing Sheets

(51) Int. Cl.
*B65H 45/12* (2006.01)
*G09F 1/06* (2006.01)

(58) Field of Classification Search
USPC ..... 493/405, 397, 404; 40/124.08, 124.14, 40/539; 428/43, 12, 42.1, 42.2, 42.3; 229/939
See application file for complete search history.

(56) References Cited

U.S. PATENT DOCUMENTS 5,293,706 A * 3/1994 Wood ..... G09F 1/06 40/124.08
5,817,378 A * 10/1998 Otani ..... A63H 33/38 428/12
6,068,903 A * 5/2000 Volkert ..... B42D 15/008 40/539
6,117,061 A * 9/2000 Popat ..... B31B 1/88 493/325
6,311,418 B1 * 11/2001 Crowell ..... G09F 1/08 283/117
2002/0029499 A1 * 3/2002 Volkert ..... G09F 1/06 40/124.08
2002/0047263 A1 * 4/2002 McCarthy ..... B42D 15/00 283/107
2002/0117405 A1 * 8/2002 Wang ..... B65B 25/008 206/5.1
2004/0026489 A1 * 2/2004 Hodsdon ..... B65D 27/00 229/92.8
2004/0181987 A1 * 9/2004 Flynn ..... G09F 3/10 40/638
2004/0216338 A1 * 11/2004 Tsuji ..... G09F 1/06 40/124.08
2005/0218020 A1 * 10/2005 Lucas ..... B65D 5/4216 206/315.9
2007/0200336 A1 * 8/2007 Wilen ..... B42D 15/027 283/74
2008/0229633 A1 * 9/2008 Yi ..... B42D 15/042 40/124.08
2010/0146828 A1 * 6/2010 Condor ..... G09F 1/06 40/124.14
2010/0269380 A1 * 10/2010 Wilen ..... B42D 15/027 40/124.12
2010/0270181 A1 * 10/2010 Morgan ..... B65D 5/2057 206/45.29
2010/0314276 A1 * 12/2010 Wilen ..... B42D 5/025 206/459.5
2011/0025037 A1 * 2/2011 Wilen ..... B42D 5/025 283/56
2012/0015117 A1 * 1/2012 Wilen ..... B42D 15/045 428/7

FOREIGN PATENT DOCUMENTS

GB 2410214 7/2005
WO WO 9740979 11/1997

OTHER PUBLICATIONS

Photomagix, Inc., PhotoMagiXX Instruction Manual, webpage: www.photomagix.net/Xeror/PhotoMagiXX_UserManual.pdf, p. 12., Retrieved Dec. 4, 2013.
Xerox Corporation, Xerox Specialty Photo Paper Products, webpage: www.xerox.com_downloads_usa_en_7_701P49612_SpecialtyPhotoPaper_SS_R0_082812-mr.pdf, Aug. 2012, p. 2, Retrieved Dec. 4, 2013.
Xerox Corporation, Xerox Supplies Online Catalog, webpage: www.xerox.com_downloads_usa_en_s_Supplies_Specialty_Media_Catalog.pdf, Sep. 2012, p. 27, Retrieved Dec. 4, 2013.

* cited by examiner

SHEET ASSEMBLY FOR THREE-DIMENSIONAL INFORMATIONAL CARD

CROSS REFERENCE TO RELATED APPLICATIONS

This application is a divisional application of co-pending U.S. application Ser. No. 14/075,199 filed Nov. 8, 2013.

STATEMENT REGARDING FEDERALLY SPONSORED RESEARCH OR DEVELOPMENT

N/A

BACKGROUND OF THE INVENTION

1. Field of the Invention

The present invention generally relates to information and signage devices and more specifically to an assembly and related methodology for a three-dimensional informational card or sign.

2. Description of Related Art

Traditional business cards known in the art are generally thin 3½"×2" planar sheets containing written indicia on one or both sides thereof. While these traditional business cards can be elegant and informational, they often lack style, creativity, and be generally uninteresting. There has been a recent trend to provide alternatives to the traditional rectangular 3½"×2", such as square, diamond, circular, hexagonal or the other "odd-shaped" business cards. Nonetheless, these alternatively-shaped business cards do not provide more than two surfaces on which to print indicia and provide information. Accordingly, while business cards are useful for typical business exchanges, they simply do not hold as much information as might be needed to truly entice a perspective client, customer, or the like. Indeed, as technology and information becomes more abundant, traditional cards may become insufficient to carry web addresses, social media names, addresses, logos, and other indicia relevant to user's business. Hence there is a need in the art for a business or information card that provides richer and more informative experience, while at the same time maintaining the common, wallet-sized dimensions of traditional business cards.

It is further appreciated that traditional business cards can be printed on paper sheets using a printer of any kind. A variety of sheets are available to print traditional business cards and these sheets usually contain a plurality of horizontal and vertical perforations or scoring lines delimiting one or more business cards that, once printing has taken place, allow the user to remove each business card from the primary sheet. These traditional business card printing sheets provide a simple and efficient method to print and easily remove each card from the scoring lines or perforated lines. For example, European Patent No. EP 1927478 to Cross describes a paper sheet sized to 8½"×11" having a plurality of scoring lines that allows the primary sheet to be cut into a plurality of 3½"×2" business cards. In one embodiment, the invention in Cross describes a single sheet assembly providing space and scoring lines to produce ten or more business cards. U.S. Pat. No. 4,704,317 and PCT International Application No. WO 97/40979 also describe various embodiments of sheets having scoring lines, perforations, and sheet separation capabilities. However, these references are concerned with traditional business cards and print media; none describe a sheet or sheet assembly providing expanded indicia-bearing capabilities.

It is, therefore, to the effective resolution of the aforementioned problems and shortcomings of the prior art that the present invention is directed. However, in view of the business and informational cards and related sheets in existence at the time of the present invention, it was not obvious to those persons of ordinary skill in the pertinent art as to how the identified needs could be fulfilled in an advantageous manner.

SUMMARY OF THE INVENTION

The present invention provides a printable sheet assembly that assembles into a three-dimensional multi-indicia containing informational card or display sign. In one aspect of the present invention, provided is a sheet assembly or apparatus that can be easily folded into a three-dimensional object that is operable between a plurality of positions, including a substantially flat planar card and a three-dimensional cube shaped display sign. Also disclosed is a method for populating, printing, and assembling the informational card or display.

In particular, the present invention provides an alternative to traditional business cards by providing an assembly comprising, in one embodiment, a card assembly having a plurality of bendable areas or scoring lines that allow the assembly to be formed into a foldable box-like configuration wherein one or more sides or sections of the assembly can contain informational indicia. In some embodiments, the sheet section is divided into at least four substantially equal sub-sections wherein the first and last sub-sections can be joined by an adhesive such as glue or a pre-applied peel-and-stick adhesive material. Alternatively, the two sections can also be mounted using a mechanical latch disposed on one of the end sections of the card assembly or prong and slot combination on either end of the assembly. In some embodiments, the card assembly includes four score lines delimiting five contiguous card sections wherein the first and second end card sections are overlapped and attached to either other. In other embodiments, the card assembly includes three score lines delimiting four contiguous card sections wherein the edges of the first and second ends are joined. The card assembly is manually operable between a box-like configuration and a flat planar configuration and is further capable of standing upright on its own on a flat surface when in the box-like configuration to provide display and signage capabilities in the same form factor as a flat planar business card or sign.

In addition to the card assembly itself, the present invention also provides a printable sheet assembly or stock comprising a plurality of removable and foldable card assemblies. The sheet assembly can easily be printed with special software on a printer such as inkjet, laser jet, thermal, impact, and/or dot matrix printer. The two-sided design permits the use of the inside and outside section providing greater printable surface area compared to traditional business cards.

Accordingly, it is an object of the present invention to provide a new and novel three-dimensional informational card assembly that is operable between a box-like configuration and a flat configuration in order to provide a plurality of surfaces on which to display indicia such as text, graphics, and pictures and to provide a new and interesting informational card that can stand upright on its own on a flat surface.

It is another object of the present invention to provide a printable sheet assembly that permits printing of a plurality of the three-dimensional card assemblies, allowing the user to remove each from the sheet assembly and then assemble the card assemblies into the final product.

It is another object of the present invention to provide an enhanced business and informational card or display device that uniquely displays a wide variety of information and is manually operable by the user in new and interesting ways.

In accordance with these and other objects which will become apparent hereinafter, the instant invention will now be described with particular reference to the accompanying drawings.

DETAILED DESCRIPTION

Figure 1A:
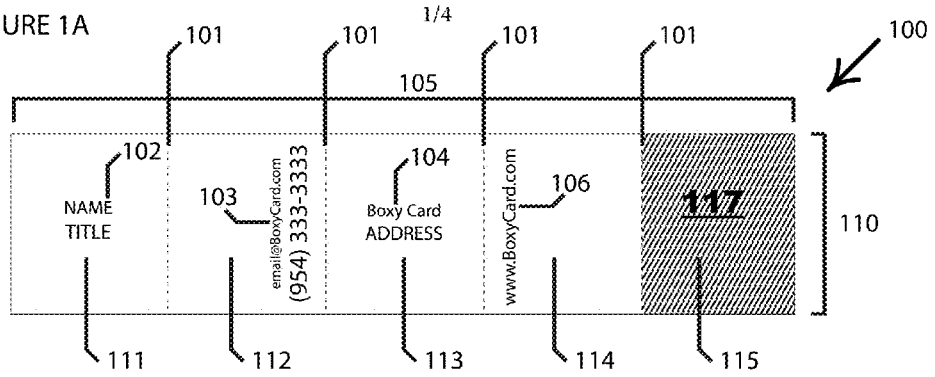
FIG. 1A is a top elevation view of the outside of one embodiment of the card assembly of the present invention.
Figure 1B:
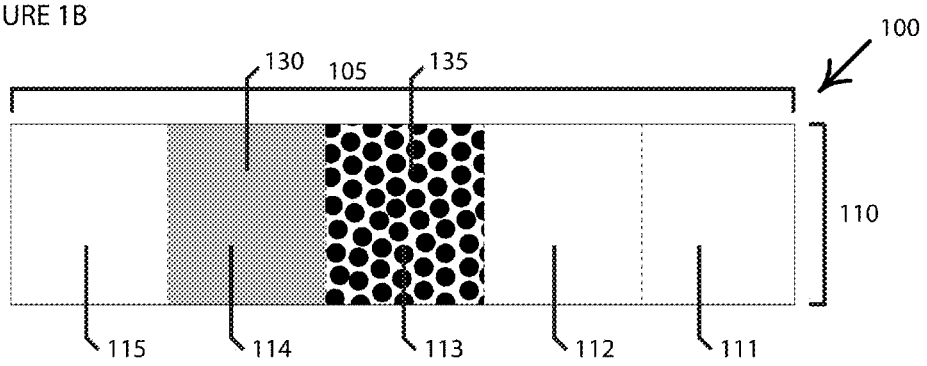
FIG. 1B is a top elevation view of the inside of one embodiment of the card assembly of the present invention.

The present invention provides a plurality of embodiments of a three-dimensional informational card, display, or sign assembly and a complementary printable sheet assembly and related methodology. FIG. 1A is a top elevation view of the outside of one embodiment of the informational card assembly 100 of the present invention. As shown, card assembly 100 generally comprises a rectangular planar body having a width 105 and a height 110. The card assembly 100 includes a plurality of score lines 101 disposed across the height of the card assembly 100 that delimit a plurality of contiguous card sections 111, 112, 113, 114, and 115. It is appreciated that, in some embodiments, four score lines 101 will delimit five contiguous card sections 111, 112, 113, 114, and 115. In other embodiments, such as FIG. 2D, three score lines are provided that delimit four card sections. In some embodiments, the score lines 101 are located at equidistant increments along the width 105 of the card assembly 100 such that each of the contiguous sections 111, 112, 113, 114, and 115 are substantially equal. In other embodiments, the score lines 101 may not be equidistant in order for certain of the card sections to be somewhat wider than others. Each card section may include a variety of written or printed indicia 102, 103, 104, and 106 which are intended to be exemplary rather than limiting. FIG. 1B is a top elevation view of the inside of one embodiment of the card assembly 100 of the present invention. Shown again are contiguous card sections 111, 112, 113, 114, and 115. Here, one or more of the card sections may include printed or written indicia 130 and 135.

Figure 1C:
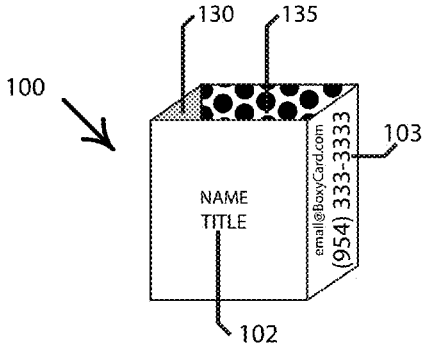
FIG. 1C is a perspective view of one embodiment of the card assembly of the present invention configured as a foldable cube.

In some embodiments, the card assembly 100 of the present invention is configured to be formed into a four sided cube configuration as shown for example in FIG. 1C. In order to form the cube configuration, in some embodiments, the card assembly 100 is folded along each score line 101 in the same direction and two card sections, sections 111 and 115 at the respective ends of the card assembly 100 are overlapped and joined together, providing a four sided cubic or box-like card assembly 100. In some embodiments, the second end card section 115 is overlapped and joined to the first end card section 111 by way of glue, a peel-and-stick adhesive 117, or by a mechanical fastening means such as a latch, hook, or prong and slot as shown in FIG. 2D. As noted above, the card sections 111-115 need not all have the same width; rather, in some embodiments, the second end card section 115 may be narrower than the other sections as it can be used solely as a mounting tab when attaching section 115 to section 111. Other variations of the size and width of second end section 115 may be utilized provided the card assembly 100 can still be joined at the ends to form the box-like final product shown in FIGS. 1C and 1D.

Figure 1D:
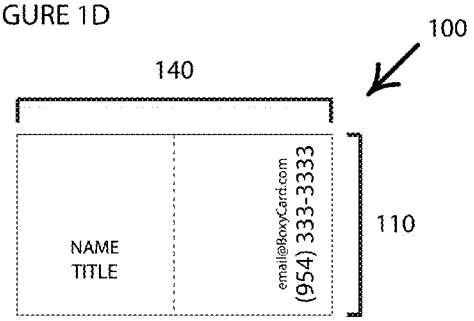
FIG. 1D is a perspective view of one embodiment of the card assembly of the present invention configured as a substantially planar card.
Figure 4:
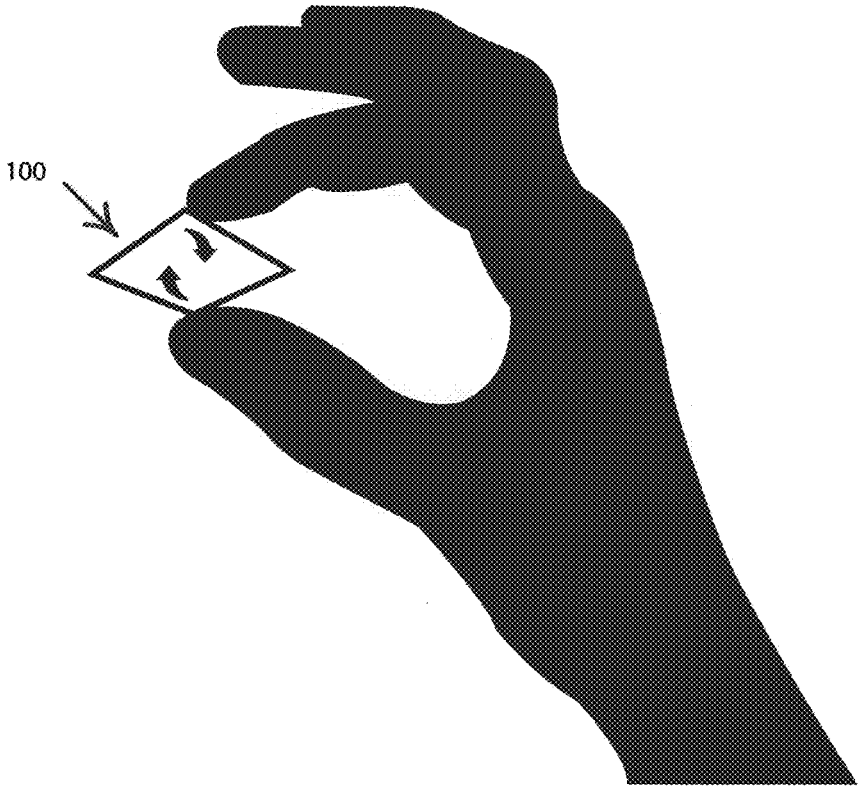
FIG. 4 shows an exemplary embodiment of a user manually manipulating one embodiment of the card assembly of the present invention from a first operable position to a second operable position.

Thus, once the card assembly 100 is assembled by joining card section 115 and card section 111, the card assembly 100 can be manually manipulated between the box-like configuration shown in FIG. 1C and a flat, planar configuration shown in FIG. 1D. Accordingly, the card assembly 100 can function as an enhanced business or informational card providing a plurality of sections on which to place written or printed indicia such as text, pictures, images, shapes, and the like. FIG. 4 demonstrates a user manually pressing down on adjacent corners of the card assembly 100 to convert it from the box-like position to a flat planar card position.

It is useful to provide some relative dimensions of the card assembly; however the following shall not be construed as limiting in any respect as the dimensions can vary to provide a final product of any size desired. In some embodiments, it is desired that the card assembly 100 be dimensioned so that in the flat planar configuration shown in FIG. 1D, the assembled card assembly 100 has the dimensions of a standard 3½"×2" business card. Accordingly, in some embodiments, the width 105 of the card assembly 100 is approximately 8¾" thereby providing five substantially equally sized contiguous sections 111, 112, 113, 114, and 115 having a width of approximately 1¾" each. The height 110 of the card assembly 100, in some embodiments, is 2". Accordingly, with the card assembly 100 assembly by joining and substantially completely overlapping sections 115 and 111, the nominal width 140 (FIG. 1D) is 3½" and the nominal height 110 is 2", thereby having the dimensions of an industry standard business card when in the flat, planar position. As is appreciated, the three-dimensional card assembly 100 can contain all traditional information found in any standard business card and can be positioned in ways that when the card is flattened FIG. 1D, the length 140 and height 110 correspond exactly to a traditional business card size of 3½" length 140, and 2" height 110. In this embodiment, indicia 102, 103, 104 and 106 will be displayed as front and back of the card assembly 100 in the planar position. In the box-like position shown in FIG. 1C, indicia 102, 103, 104, and 106 is visible on the outside and indicia 130 and 135 is visible on the inside. It is appreciated that the orientation of the sections of the assembled card assembly 100 can be varied by manually manipulating the card assembly 100 along the various fold lines as shown in FIG. 4. This allows the location and orientation printed indicia to be varied to allow for the card assembly 100 to be dynamic with respect to displaying the various indicia disposed thereon.

Figure 2A:
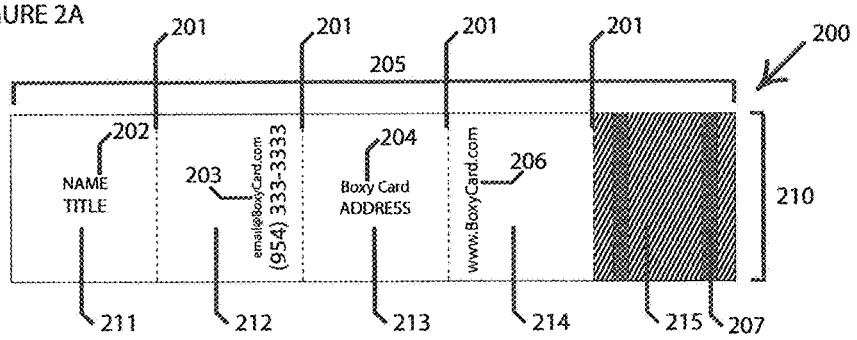
FIG. 2A is a top elevation view of the outside of another embodiment of the card assembly of the present invention.
Figure 2B:
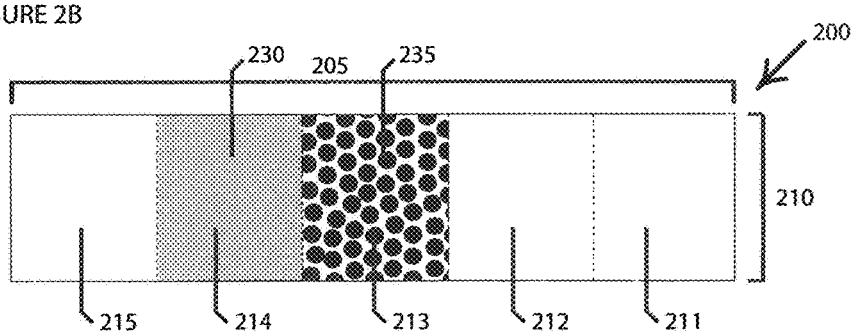
FIG. 2B is a top elevation view of the inside of another embodiment of the card assembly of the present invention.
Figure 2C:
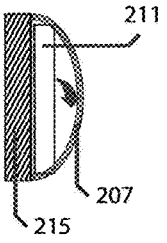
FIG. 2C is a side cross section view of an embodiment of the card assembly showing a retention feature.
Figure 2D:
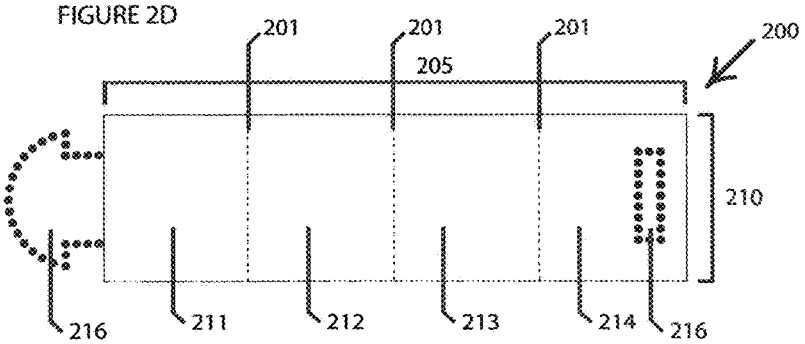
FIG. 2D is a top elevation view of an alternative embodiment of the card assembly of the present invention.

FIG. 2A is a top elevation view of the outside of another embodiment of the informational card assembly 200 of the present invention, similar. As shown, card assembly 200 generally comprises a rectangular planar sheet having a width 205 and a height 210. The card assembly 200 includes a plurality of score lines 201 that delimit a plurality of contiguous card sections 211, 212, 213, 214, and 215. It is appreciated that, in some embodiments, four score lines 201 will delimit five contiguous card sections 211, 212, 213, 214, and 215. In some embodiments, the score lines 201 are located at equidistant increments along the width 205 of the card assembly 200 such that each of the contiguous sections 211, 212, 213, 214, and 215 are substantially equal. In other embodiments, the score lines 201 may not be equidistant in order for certain of the card sections to be somewhat wider than others. Each card section may include a variety of written or printed indicia 202, 203, 204, and 206 which are intended to be exemplary rather than limiting. FIG. 2B is a top elevation view of the inside of one embodiment of the card assembly 200 of the present invention. Shown again are contiguous card sections 211, 212, 213, 214, and 215. Here, one or more of the card sections may include printed or written indicia 230 and 235. As with the card assembly 100 shown in FIGS. 1A-1D, the card assembly 200 is also configured to be assembled into a four sided box-like configuration and operable between the box-like configuration and a flat, planar card configuration. Here, however, the means by which to attach card section 215 to card section 211 is mechanical rather than adhesive. In some embodiments, the card section 215 includes one or more straps 207 disposed lengthwise across the section 215 from top to bottom. The straps 207 can be disposed on either or both sides of the card section 215 allowing the card assembly to be folded in either direction and to be reversible. As shown in FIG. 2C, to assemble the card assembly 200, card section 211 at one end of the assembly 200 is inserted into the strap 207 such that the section 211 rests adjacent to and is retained by section 215. This forms a resilient but resealable closure means by which to assemble the card assembly 200, without the need for an adhesive or glue. It is appreciated that the embodiment shown in FIGS. 2A-2C can have the same operable functionality and dimensions as described above with respect to card assembly 100.

FIG. 2D depicts a top elevation view of an alternative embodiment of the card assembly 200 of the present invention with an alternative configuration and closure means. Here, card assembly 200 comprises three score lines 201 delimiting four contiguous card sections 211, 212, 213, and 214. Here, in some embodiments, the first end section 211 is attached to second end section 214 by way of a prong and slot system 216. In other embodiments, the first end section 211 can be joined to the second end card section 214 directly at the end seams, without overlapping the sections, to form the box-like final card assembly structure shown in FIG. 1C. Such a configuration may be accomplished by applying an adhesive or glue to outer edges of the first and second end sections 211 and 214, obviating the need for the additional fifth section 215 shown in FIGS. 2A and 2B.

Figure 3A:
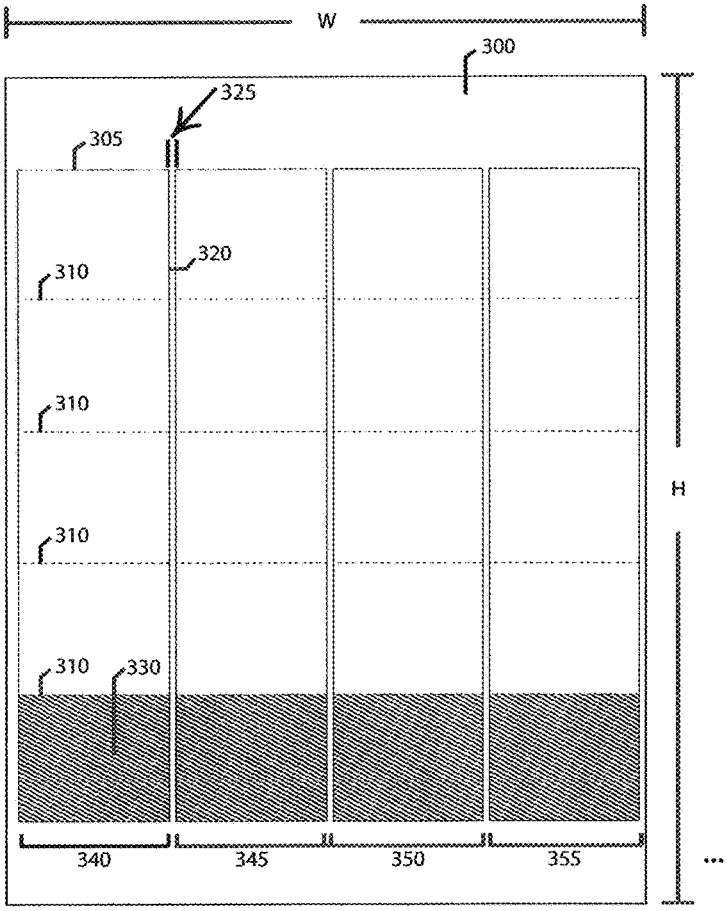
FIG. 3A is a top elevation view of one embodiment of the printable sheet assembly of the present invention having a plurality of card assemblies delimited thereon.

It is appreciated that the informational card assembly 100 or 200 of the present invention is configured to receive printed indicia such as text, images, graphics and the like. In order to provide a simple and effective means of printing indicia on the assemblies 100 or 200, the present invention provides a printable sheet assembly 300 that comprises a plurality of card assemblies that are removable and releasable from the sheet assembly for later assembly and use. The printable sheet assembly 300 functions as a template to print, remove, and assemble a plurality of individual card assemblies 100 (or 200). Accordingly, with reference to FIG. 3A, shown is one side of the printable sheet assembly 300 having a plurality of horizontal perforated lines 305 and vertical perforated lines 320 that delimit four card assemblies 340, 345, 350, and 355. The perforated lines 305 and 320 allow for easy removal of each card assembly. In some embodiments, adjacent card assemblies are spaced apart by a gap 325, which gap 325 is delimited by adjacent vertical perforated lines 320. The width of gap 325 can vary as need be depending on the size of the sheet assembly 300 and the number of card assemblies delimited thereon. In other embodiments, the adjacent perforated lines 320 are shared between adjacent card assemblies and therefore there is no gap 325.

Figure 3B:
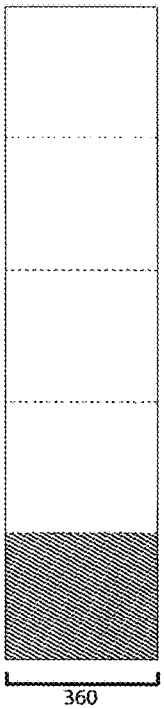
FIG. 3B is a top elevation view of one embodiment of the card assembly of the present invention as separated from the printable sheet assembly.

An example of a card assembly 360 removed from sheet assembly 300 by way of perforated lines 305 and 320 is shown in FIG. 3B. Referring back to FIG. 3A, sheet assembly 300 will contain a certain number of card assemblies depending on the width W and height H of the sheet assembly 300. Each of the card assemblies 340, 345, 350, and 355 include a plurality of score lines 310 disposed across the card assemblies that function as folding lines to assemble the informational card assemblies as described above. Additionally, in some embodiments, the end section 330 may be pre-applied with an adhesive such as a glue or a peel-and-stick adhesive to allow the user to easily assemble the card assembly after printing and processing the sheet assembly 300. In other embodiments, the user provides their own adhesive or a discrete adhesive is pre-packaged with the sheet assemblies 300 for application by the user after printing.

Figure 3C:
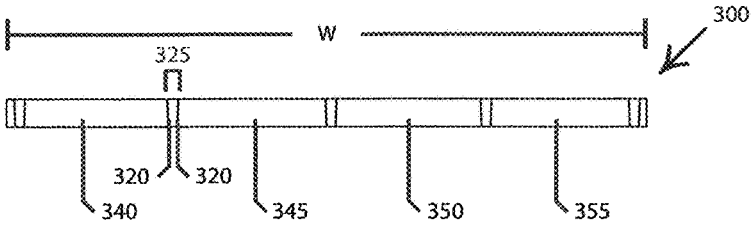
FIG. 3C is a cross-sectional side view of one embodiment of the printable sheet assembly of the present invention showing a plurality of perforated lines thereon.

FIG. 3C is a cross-sectional view of sheet assembly 300 viewed from the end. Shown are the adjacent card assemblies 340, 345, 350, and 355 separated by gap 325. Gap 325 is disposed between adjacent vertical perforated lines 320. In the case where the gap 325 is eliminated, adjacent card assemblies will share a single vertical perforated line 320.

In some embodiments, by way of example, assembly sheet 300 is configured as a standard printer-friendly 8½"× 11" assembly that can accommodate up to four card assemblies to create four three-dimensional informational cards as the final product. The sheet assembly 300 is adapted to feed into a desktop printer and receive printed indicia according to, in some embodiments, a computerized digital template usable on a word processing, graphic design, publisher, or like similar software program. Additionally, a website may be provided to allow a user to customize the printable indicia on the card assemblies and print the assemblies themselves by way of sheet assembly 300 or place an order through a third-party vendor who carries out professional printing and assembly of the card assemblies. In the case of an 8½"×11" sheet assembly 300, in some embodiments, the sheet assembly 300 includes four card assemblies wherein the score lines 310 are spaced approximately 1¾" apart along each card assembly 340, 345, 350, 355. The width of each card assembly is, for example, 2" in order to result in a final assembly card assembly having standard business card dimensions of 3½"×2" when in the flat, planar position. It is appreciated that the paper size of sheet assembly 300 can be varied with respect to various standardized paper sizes such as legal sized (8.5"×14"), A4 sized, and the like whereby these various sizes provide additional printable space to accommodate more card assemblies. Additional custom sized sheet assemblies 300 could be provided based on the desired number of card assemblies per sheet and further based on the capabilities of a given printer.

The present invention also contemplates various methods relating to the printing, assembly, and use of the card assembly of the present invention. In one embodiment, a method of producing and assembling a three dimensional informational card by way of a computing device (personal computer, laptop, mobile device, tablet computer, and the like) comprises loading, either locally on the computing device or remotely by way of a website interface, a template relating to the sheet assembly with a plurality of images, text, and pictures, providing a sheet assembly into a printer whereby the sheet assembly includes one or more designated card assemblies corresponding to the template, printing on the card assemblies the plurality of images, text, and pictures corresponding to the template, removing each card assembly from the sheet assembly, bending or folding each section of the card assembly in the same direction, and attaching a card section on a first end of the card assembly to a card section on a second end of the card assembly to form the three-dimensional informational card. The resultant informational card is then operable between a first three-dimensional box-like configuration and a flat, planar configuration by pressing along the corners of the card assembly as shown in FIG. 4.

The present invention provides a unique and interesting alternative to traditional business cards and other types of displays and informational products. As noted above, a common business card contains text and perhaps a business logo on just one side of the card. The present invention, on the other hand provides at least four outer surfaces and four inner surfaces, delimited by the card sections, on which indicia such as graphics, text, pictures, and drawings can be provided. Thus, the present invention provides eight times the usable spaces as compared to a traditional business card. Moreover, the ability of the card assembly to be manipulated from a flat, planar position to a box-like position and back again provides an unlimited number of creative ways to utilize the invention. For example, a user can place general contact information on the outer sides of the card assembly so that when in the flat position the assembly appears as a standard business card. However, when opened up into the box-like position, a user can view interesting information, graphics, drawings, or pictures printed on the inside of the assembly. This allows a business-owner to provide additional information about his/her business not otherwise available on traditional business cards, ultimately helping to attract customers in a unique and interesting manner. Additionally, because of the box-like configuration, the card assembly can stand in an upright position on a flat surface therefore providing a unique and eye-catching way of displaying a variety of indicia including contact information, pictures, and the like. Thus, the present invention provides a substantial advantage over traditional business cards and other information-bearing devices known in the art.

It is appreciated that the present invention contemplates a card assembly that results in a final product having dimensions similar to a typical business card known in the art. However, the present invention is not limited in any way to these dimensions as the size of the card assembly can be varied as desired without departing from the spirit and scope of the present invention. Accordingly, the card assembly can be provided in a variety of shapes and sizes for use as business cards, informational cards, brochures, table top displays, hanging displays, convention displays. Further, the individual card sections can be rectangular or polygonal as desired, provided the functionality and operability of the invention is not affected. Additional shapes are completed provided the sections are continuous and additional features such as cut-outs, impressions, embossing, and stamping can be included in the card sections without affecting the final assembled product. Thus, the capabilities and possible uses for the overall design of the present invention are quite broad. Further still, the card assembly and related sheet assembly can comprise a variety of materials and combinations of materials such as paper, card stock, plastic, resin, wood, and combinations thereof provided such material is sufficient strong and durable yet pliable and resilient enough to allow for folding for assembly and manipulation between the at least two operable positions, box-like and flat, planar. Additionally, in some embodiments, the card assembly can include or be comprised at least in part of LCDs (liquid crystal display), LEDs (light emitting diode), LED displays, OLED (organic light emitting diode), EPD (electronic paper display), LCD display, flexible electronic displays, and other electronic display and lighting devices known in the art.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A method of producing and assembling a three dimensional informational card comprising:

providing a sheet assembly into a printer whereby said sheet assembly includes one or more designated said informational card assemblies;

printing on said informational card assemblies plurality of images, text, pictures, and combinations thereof;

removing each card assembly from the sheet assembly by way of perforation pre-applied to said sheet assembly;

bending or folding said card assembly along a plurality of score lines provided across said card assembly, said score lines each delimiting said card assembly into a plurality of card sections including a first end section and a second end section;

attaching said first end section of said card assembly to said second end section of said card assembly to form said three dimensional informational card; and after said three dimensional informational card is formed, said three dimensional informational card is manually operated from a three-dimensional four-sided cubic configuration to a flat planar configuration and back again.

2. The method of claim 1, wherein each card assembly includes four equally spaced said score lines delimiting five contiguous card sections, wherein said first end at least partially overlaps and attaches to said second end.

3. The method of claim 2, wherein said first end and said second end are overlapped and joined together such that said informational card assembly has four sides wherein said overlapped first and second end sections together comprise one of said four sides.

4. The method of claim 3, wherein a width of said card assembly is 8¾" such that each of said sections is 1¾" wide.

5. The method of claim 2, wherein said sheet assembly in assembled form includes four outer surfaces and four inner surfaces, with at least one of said inner surfaces having printing thereon, such that when in said three-dimensional configuration said printing on said at least one inner surface is visible.

6. A method of producing and assembling a three dimensional informational card comprising:

providing said informational card comprising a planar card body, at least three score lines disposed on said body, said score lines delimiting at least four contiguous card sections along said card assembly, said card sections including a first end section and a second end section;

printing on said informational card a plurality of images, text, pictures, and combinations thereof;

bending or folding each said card section along said score lines;

attaching said first end section of said card assembly to said second end section of said card assembly to form said three dimensional informational card; and after said three dimensional informational card is formed, said three dimensional informational card is manually operated from a three-dimensional four-sided cubic configuration to a flat planar configuration and back again.

7. The method of claim 6, wherein said first end section and said second end section are overlapped and joined together such that said informational card assembly has four sides wherein said overlapped first and second end sections together comprise one of said four sides.

8. The method of claim 7, wherein each card assembly includes four equally spaced score lines delimiting five contiguous card sections, wherein said first end at least partially overlaps and attaches to said second end.

9. The method of claim 8, wherein a width of said card assembly is 8¾" such that each of said sections is 1¾" wide.

10. The method of claim 6, wherein said sheet assembly in assembled form includes four outer surfaces and four inner surfaces, with at least one of said inner surfaces having printing thereon, such that when in said three-dimensional configuration said printing on said at least one inner surface is visible.

11. A method of producing and assembling a three dimensional informational card by way of a computing device comprising:

loading, on said computing device, a template corresponding to a sheet assembly with a plurality of images, text, pictures, and combinations thereof, said sheet assembly delimiting one or more informational card assemblies;

providing said sheet assembly into a printer whereby said sheet assembly includes one or more designated said informational card assemblies corresponding to said template, printing on said informational card assemblies said plurality of images, text, pictures, and combinations thereof corresponding to the template;

removing each card assembly from the sheet assembly by way of perforation pre-applied to said sheet assembly;

bending or folding each section of the card assembly along a plurality of score lines provided across said card assembly;

attaching a card section on a first end of said card assembly to a card section on a second end of said card assembly to form said three dimensional informational card; and after said three dimensional informational card is formed, said three dimensional informational card is manually operated from a three-dimensional four-sided cubic configuration to a flat planar configuration and back again.

12. The method of claim 11, wherein a width of said card assembly is 8¾" such that each of said sections is 1¾" wide.

13. The method of claim 11, wherein said sheet assembly in assembled form includes four outer surfaces and four inner surfaces, with at least one of said inner surfaces having printing thereon, such that when in said three-dimensional configuration said printing on said at least one inner surface is visible.

* * * * *